US009915924B2

(12) United States Patent
Sagardoyburu

(10) Patent No.: US 9,915,924 B2
(45) Date of Patent: Mar. 13, 2018

(54) MOTHER-OF-PEARL DIAL FOR A HIDDEN DISPLAY

(71) Applicant: THE SWATCH GROUP RESEARCH AND DEVELOPMENT LTD, Marin (CH)

(72) Inventor: Michel Sagardoyburu, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 20 days.

(21) Appl. No.: 15/035,031

(22) PCT Filed: Nov. 13, 2014

(86) PCT No.: PCT/EP2014/074526
§ 371 (c)(1),
(2) Date: May 6, 2016

(87) PCT Pub. No.: WO2015/071376
PCT Pub. Date: May 21, 2015

(65) Prior Publication Data

US 2016/0282814 A1 Sep. 29, 2016

(30) Foreign Application Priority Data

Nov. 15, 2013 (EP) ..... 13193176

(51) Int. Cl.

| | |
|---|---|
| ***G04B 19/12*** | (2006.01) |
| ***G04C 17/00*** | (2006.01) |
| ***G04G 9/00*** | (2006.01) |
| ***G04G 9/04*** | (2006.01) |
| ***G04G 9/10*** | (2006.01) |

(52) U.S. Cl.
CPC ..... *G04B 19/12* (2013.01); *G04C 17/0091* (2013.01); *G04G 9/0088* (2013.01); *G04G 9/047* (2013.01); *G04G 9/107* (2013.01)

(58) Field of Classification Search
CPC .... G04B 19/06; G04B 19/12; G04C 17/0091; G04G 9/0088; G04G 9/0047; G04G 9/107
See application file for complete search history.

(56) References Cited

U.S. PATENT DOCUMENTS 4,488,818 A * 12/1984 Saurer ..... G04G 9/0094 368/242
5,930,204 A * 7/1999 Sonoda ..... G04B 19/12 29/896.32

(Continued)

FOREIGN PATENT DOCUMENTS

| | | |
|---|---|---|
| EP | 1 672 436 A1 | 6/2006 |
| EP | 1 826 637 A1 | 8/2007 |
| GB | 2 023 887 A | 1/1980 |

OTHER PUBLICATIONS

International Search Report dated Oct. 5, 2015 in PCT/EP2014/074526 filed Nov. 13, 2014.

*Primary Examiner* — Vit W Miska
(74) *Attorney, Agent, or Firm* — Oblon, McClelland, Maier & Neustadt, L.L.P.

(57) ABSTRACT

A display assembly including a display including a light source and a semi-transparent element for showing the display only when the display is activated, wherein the semi-transparent element includes a mother-of-pearl dial under which is disposed a semi-reflective element.

20 Claims, 1 Drawing Sheet

(56) References Cited

U.S. PATENT DOCUMENTS

| | | | | |
|---|---|---|---|---|
| 6,515,942 | B2 * | 2/2003 | Basturk | G02F 1/1334 349/56 |
| 6,678,217 | B2 * | 1/2004 | Bastruk | G02F 1/133533 349/97 |
| 2002/0048221 | A1 * | 4/2002 | Basturk | G02F 1/133533 368/84 |
| 2004/0196742 | A1 * | 10/2004 | Gouthier | G04B 19/10 368/232 |
| 2006/0133219 | A1 | 6/2006 | Dubach et al. | |
| 2007/0195651 | A1 | 8/2007 | Kawakami | |
| 2008/0101161 | A1 | 5/2008 | Imai et al. | |

* cited by examiner

MOTHER-OF-PEARL DIAL FOR A HIDDEN DISPLAY

CROSS-REFERENCE TO RELATED APPLICATIONS

This is a National Phase Application in the United States of International Patent Application No. PCT/EP2014/076783 filed on Dec. 5, 2014 which claims priority on European Patent Application No. 13196736.6 filed on Dec. 11, 2013. The entire disclosures of the above patent applications are hereby incorporated by reference.

The present invention concerns a display assembly including a display comprising a light source and a semi-transparent element to show the display only when it is activated.

PRIOR ART

There are known from the prior art electronic watches with hands. These watches with hands may be provided with an electronic LCD display for the display of additional information. This additional information may be the date or the time in a second time zone or any other information that can be displayed by an electronic watch.

Generally speaking, the dial of such a watch is a plastic or metal dial The dial presents an opening so that the display can be seen by the user. For example, the LCD display will be bonded on the underside of the dial to be secured thereto.

To improve the aesthetics of the dial, the latter may be made of mother-of-pearl. However, the presence of an opening for the LCD display spoils the aesthetic contribution of the mother-of-pearl.

To overcome this drawback, one idea is to make a display assembly 1 which consists in disposing the display 4 and its electronic circuit 3 underneath dial 2, which does not present an opening. An electronic display that is hidden under the dial requires a semi-transparent dial. In a first mode of use, such a semi-transparent dial can conceal the movement so that only the dial and its decoration can be seen when the display is off, and in a second mode of use, it allows the electronic display to be read through the dial when the display is on.

To properly conceal the movement and the display in the off mode, it is envisaged to use a dial that will absorb or diffuse light, so that the user cannot see through the dial. Thus, it is envisaged to use a thin piece of mother-of-pearl (with a thickness of between 0.01 and 1 mm). This thin piece of mother-of-pearl is aesthetically interesting and translucent; it transmits and diffuses light at the same time. This property of diffusion makes it possible to conceal the display and the movement; the greater the diffusion, the lighter the dial will appear.

Conversely, when the display is on, it is preferable for the dial to be as transparent as possible in order to transmit greater display brightness and enhance the contrast required for reading.

Further, it is preferable for the dial to have the least possible diffusion in order to maintain the sharpness of the illuminated details of the display placed underneath the dial. Thus, the display will appear to be of lower quality, the more light the piece of mother-of-pearl diffuses.

There is therefore a compromise to be made as regards the piece of mother-of-pearl, to achieve a balance between the distortion of the image and the whiteness of the dial.

An example of a parameter that can be modified is the thickness of the mother-of-pearl, which can adapt the property of diffusion to make the mother-of-pearl lighter. If the latter is too light, i.e. too thin, the electronic display may be visible when it is off and the mother-of-pearl appears dark as seen in FIG. 1*b*. On the other hand, if the mother-of-pearl is too thick, as seen in FIG. 1*a*, the dial is prettier because the mother-of-pearl appears lighter, but the display image will be too distorted.

Consequently, it is extremely difficult to have a mother-of-pearl dial under which a display can be placed without adversely affecting the aesthetic appeal and readability of information of the display.

SUMMARY OF THE INVENTION

To this end, the invention proposes to overcome the drawbacks of the prior art by providing a display assembly wherein an electronic display is hidden underneath the dial when said display is off but which allows the information provided by said display to be perfectly readable and clear when said display is on.

The invention concerns a display assembly comprising a display module provided with a light source for displaying at least one piece of information and a dial module for showing said display information only when the display is activated, characterized in that the dial module includes a dial made of a translucent or semi-transparent material underneath which is disposed a semi-reflective element for reflecting part of the light and transmitting another proportion of the light while preventing the deflection of light rays by diffusion, said display module being disposed underneath said semi-reflective element.

In a first advantageous embodiment, the semi-reflective element includes a metallic layer directly deposited on said dial.

In a second advantageous embodiment, the semi-reflective element includes a metallic layer deposited on a flexible film.

In a third advantageous embodiment, the semi-reflective element includes a dielectric mirror in the form of a film.

In a fourth advantageous embodiment, the semi-reflective element includes a dielectric mirror made directly on said dial, with a film bonded thereon to stiffen said dial.

In a fifth advantageous embodiment, said dielectric mirror is composed of a plurality of stacked layers of dielectric materials of different refractive indices and thicknesses.

In another advantageous embodiment, said dielectric mirror is composed of a plurality of layers of birefringent dielectric materials.

In another advantageous embodiment, the film is a flexible film.

In another advantageous embodiment, the film is a rigid film.

In another advantageous embodiment, the thickness of the dial module is comprised between 0.3 and 0.5 mm.

In another advantageous embodiment, the thickness of the dial is comprised between 0.01 and 0.4 mm.

In another advantageous embodiment, the display assembly further includes an opaque film located between the display module and the dial module.

In another advantageous embodiment, the dial is made of a material from the list including: mother-of-pearl, amber, meteorites, horn, bone, leather, hide, coral, cartilage, semi-transparent minerals (silica, calcite), semi-transparent or tinted glasses, ceramics (oxides, carbides, nitrides, borides) or wood.

The present invention also concerns a timepiece that includes a display assembly according to any of the advantageous embodiments of the invention.

BRIEF DESCRIPTION OF THE DRAWINGS

The objects, advantages and features of the display assembly according to the present invention will appear more clearly in the following detailed description of at least one embodiment of the invention, given solely by way of non-limiting example and illustrated by the annexed drawings, in which.

DETAILED DESCRIPTION

Figure 1A:
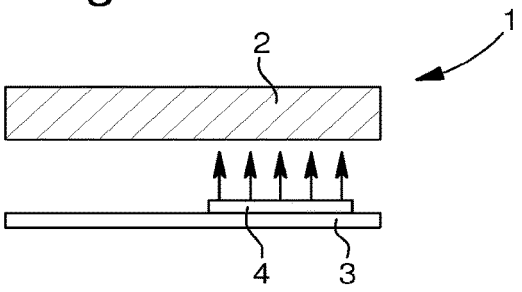
FIGS. 1*a* and 1*b* are schematic views of the display assembly according to the prior art.
Figure 1B:
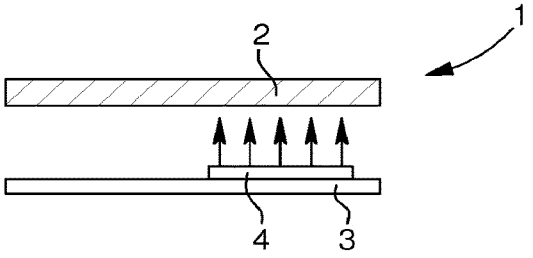
Figure 2:
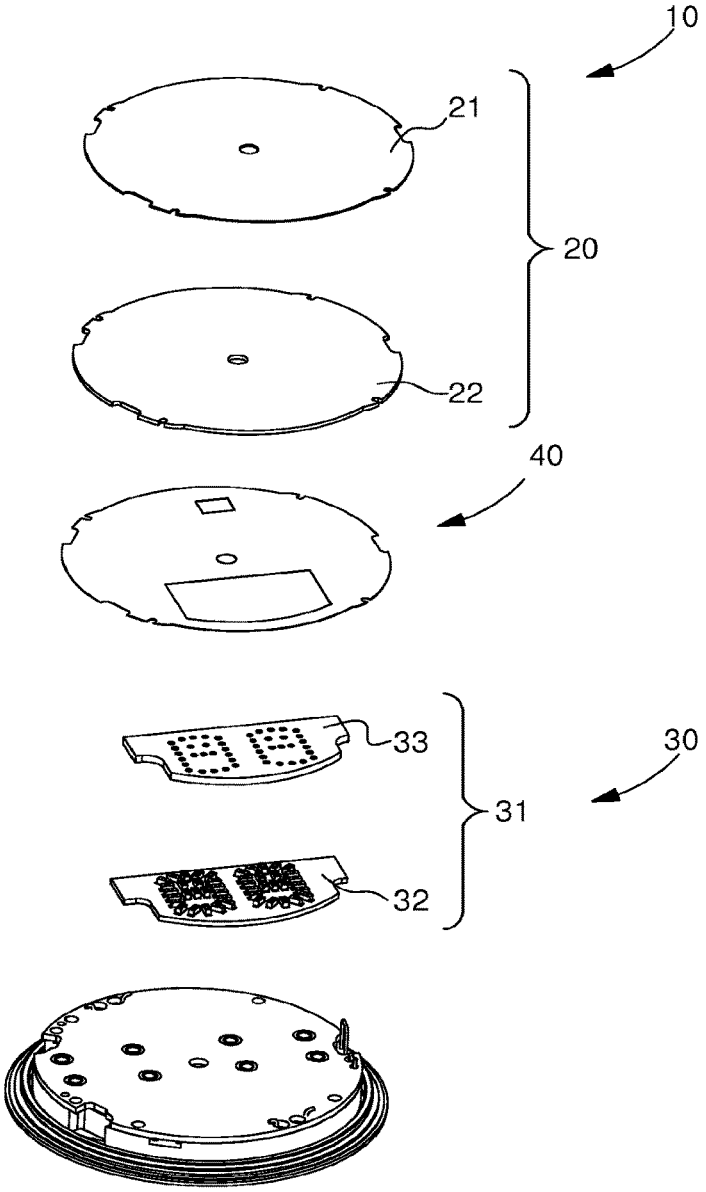
FIG. 2 is a schematic view of the display assembly according to the invention.

FIG. 2 shows a display assembly 10 according to the present invention. This display assembly 10 is arranged in a case of a portable object such as a watch. It is also possible to envisage the display assembly being arranged in a piece of jewelry such as a bracelet.

Display assembly 10 includes a dial module 20 and a display module 30. Display module 30 includes an electronic display 31 carried by a plate. This electronic display 31 is a display or digital display screen. Display 31 may use LCD or LED or OLED technology. LED or OLED technologies have the advantage of being their own light source, making it possible to have emissive displays. For LCD technology, backlighting is used. For an electronic LED display 31, the display includes a substrate serving as a circuit 32 on which the light emitting diodes (LED) are welded and a separator 33 for improving the sharpness of the details of the information displayed by the light emitting diodes. Electronic display 31 is placed under dial part 20.

To obtain an electronic display 31 which is only visible through dial module 20 when it is on, dial module 20 must be a semi-transparent element. To this end, dial module 20 thus includes a dial 21 made of a translucent or semi-transparent material. The translucent or semi-transparent material may be mother-of-pearl, amber, meteorites, horn, bone, leather, hide (such as, for example, snakeskin or crocodile skin), coral, cartilage, semi-transparent minerals (silica, calcite), semi-transparent or tinted glasses, ceramics (oxides, carbides, nitrides, borides) or wood. In fact, these materials are translucent or semi-transparent when they take the form of a thin sheet. In the following description, mother-of-pearl will be used.

Advantageously according to the invention, dial module 20 further includes a semi-reflective element 22. This semi-reflective element 22 is used to achieve a white mother-of-pearl dial 21 and an electronic display 31 that is concealed when the display is off and to achieve display information that is clearly visible in sharp detail when electronic display 31 is on.

To this end, semi-reflective element 22 is combined with a dial 21 of a given thickness. Indeed, the thickness of the mother-of-pearl is a parameter that allows adjustment of the diffusion properties to make the mother-of-pearl lighter. A compromise must be found, since if the mother-of-pearl is too light, electronic display 31 may be visible when off and the mother-of-pearl will appear dark. Conversely, if the mother-of-pearl is too thick, it appears lighter but the detailed information of electronic display 31 will be distorted by diffusion.

In the case of the present invention, mother-of-pearl dial 21 will have a thickness comprised between 0.01 and 0.4 mm with preferred values of 0.1 mm and 0.15 mm. This range of thickness of the mother-of-pearl makes it possible to obtain a translucent dial 21 which transmits and diffuses light at the same time. The total thickness of dial module 20 is comprised between 0.3 and 0.5 mm.

The combination of a mother-of-pearl dial 21 of small thickness and a semi-reflective element 22 enables part of the light to be reflected and another proportion of the light to be transmitted without deflecting light rays by diffusion. Consequently, when electronic display 31 is off, it is possible to make the mother-of-pearl whiter, since semi-reflective element 22 placed behind mother-of-pearl dial 21 helps said mother-of-pearl dial 21 to reflect more light.

Further, the total diffusion of dial module 21 is the diffusion of mother-of-pearl dial 21. Since diffusion varies proportionally with thickness, a mother-of-pearl dial 21 of small thickness results in low diffusion which makes it possible to maintain the sharpness of detail of electronic display 31 when the latter is on. Thus, the advantage in terms of diffusion of a thin mother-of-pearl is combined with the advantage in terms of whiteness of a thick mother-of-pearl.

In a first embodiment, semi-reflective element 22 is a semi-reflective mirror. Such a mirror is formed of a metal layer. This metal layer may be made of chromium or silver or aluminium or any other metal or alloy capable of making such a mirror. This metal layer has a thickness comprised between 1 and 50 nm.

The metal layer may be deposited directly on mother-of-pearl dial 21 on the surface thereof that is not visible to the user, or via a substrate. To achieve this, a transparent plastic or other substrate is coated with the metal layer and then bonded to mother-of-pearl dial 21. The presence of the substrate makes it possible to obtain an additional layer which will stiffen dial module 20 and give the latter greater mechanical stiffness. Dial module 20 will thus be easier to handle.

In a second embodiment semi-reflective element 22 includes a dielectric mirror. Such a dielectric mirror is composed of a plurality of layers of dielectric materials deposited in succession. Dielectric mirror manufacturing techniques are based, for example, on thin layer deposition methods. Common techniques are molecular beam epitaxy, ion beam deposition, vapour phase deposition, physical vapour phase deposition, and sputter deposition. These layers of dielectric materials have different refractive indices and thicknesses. Consequently, through a phenomenon of constructive interference, the rate of light reflection can be considerably increased. The simplest dielectric mirrors 22 are generally coloured so as to colour the mother-of-pearl and thereby provide more in terms of aesthetics. It is, however, possible to obtain neutral-coloured dielectric mirrors by combining more complex layers of dielectric materials to reflect all the visible wavelengths with the same intensity. In this manner, mother-of-pearl dial 21 maintains its original colour but appears brighter to the user.

The use of a dielectric mirror offers improved efficiency with respect to a mirror in the form of a metallic layer or layers as the latter absorbs part of the light.

In a variant of the second embodiment, the dielectric mirror of semi-reflective element 22 is made using birefringent dielectric layers. This use of birefringent dielectric layers causes the appearance of a phenomena of polarized constructive interference which offers the advantage of having a more neutral colour, making the mother-of-pearl whiter. Such a mirror formed of birefringent dielectric layers is called a reflective polarizer and can transmit one polarization while reflecting another.

These reflective polarizers or dielectric mirrors may take the form of a film, i.e. a thin layer of material such as a sheet. The fact that they take the form of a film means that when these reflective polarizers or dielectric mirrors are associated with a mother-of-pearl dial, greater mechanical stiffness is obtained. Dial part 20 will thus be easier to handle. The film may be flexible or stiff and be made of plastic or a material such as glass or any other usable material.

It is also possible for these reflective polarisers or dielectric mirrors to be made directly on dial 21, on the surface thereof that is not visible to the user, with a stiff or flexible film being bonded thereon to increase the stiffness of dial 21.

This variant is ingenious in that these reflective polarizers are generally used in electronic displays to recycle energy or to be used as polarizing mirrors for reflective displays. The use of such reflective polarizers is not therefore intended to increase the whiteness of a piece of mother-of-pearl.

Further, this variant has the advantage of being commercially available in the form of a plastic film. It is then possible to envisage laminating the film on the mother-of-pearl, thereby avoiding the use of complex and expensive thin layer deposition methods.

In FIG. 2, semi-reflective element 22 is shown in the form of a film or substrate either carrying a semi-reflective mirror or a dielectric mirror. The version where semi-reflective element 22 is made directly on dial 21 is not illustrated.

In a variant of the first and the second embodiment, the display assembly also includes an opaque film 40 placed between electronic display 31 and dial module 20 comprising mother-of-pearl dial 21 and semi-reflective element 22. Indeed, it is preferable to have a movement having a uniform colour behind dial 21, otherwise there will be differences in shade in the mother-of-pearl dial. Film 40 thus serves to conceal screws and other reflective parts which are found in the movement. This prevents them being visible to the user. This opaque firm 40 has an opening at the place opposite to electronic display 31, so that the information displayed by electronic display 31 can be seen by the user. The colour black is selected to enhance the mother-of-pearl and obtain a very uniform background.

It will be clear that various alterations and/or improvements and/or combinations evident to those skilled in the art may be made to the various embodiments of the invention set out above without departing from the scope of the invention defined by the annexed claims.

The invention claimed is:

1. A display assembly comprising:

a display module including a light source to display at least one piece of information; and a dial module to show the display information only when the display is activated, wherein the dial module includes a dial made of a translucent or semi-transparent material underneath which is disposed a semi-reflective element to reflect part of light and to transmit another proportion of light while reducing deflection of light rays by diffusion, the semi-reflective element completely covers the light source, and the display module being disposed underneath the semi-reflective element.

2. The display assembly according to claim 1, wherein the semi-reflective element includes a metallic layer directly deposited on the dial.

3. The display assembly according to claim 1, wherein the semi-reflective element includes a metallic layer deposited on a flexible film.

4. The display assembly according to claim 1, wherein the semi-reflective element includes a dielectric mirror in a form of a film.

5. The display assembly according to claim 1, wherein the semi-reflective element includes a dielectric mirror made directly on the dial, with a film being bonded thereon to stiffen the dial.

6. The display assembly according to claim 4, wherein the dielectric mirror includes a plurality of stacked layers of dielectric materials having different refractive indices and thicknesses.

7. The display assembly according to claim 5, wherein the dielectric mirror includes a plurality of stacked layers of dielectric materials having different refractive indices and thicknesses.

8. The display assembly according to claim 4, wherein the dielectric mirror includes a plurality of layers of birefringent dielectric materials.

9. The display assembly according to claim 5, wherein the dielectric mirror includes a plurality of layers of birefringent dielectric materials.

10. The display assembly according to claim 4, wherein the film is a flexible film.

11. The display assembly according to claim 5, wherein the film is a flexible film.

12. The display assembly according to claim 4, wherein the film is a rigid film.

13. The display assembly according to claim 5, wherein the film is a rigid film.

14. The display assembly according to claim 1, wherein thickness of the dial module is between 0.3 and 0.5 mm.

15. The display assembly according to claim 1, wherein thickness of the dial is between 0.01 and 0.4 mm.

16. The display assembly according to claim 1, further comprising an opaque film located between the display module and the dial module.

17. The display assembly according to claim 1, wherein the dial is made of a material of at least one of: mother-of-pearl, amber, meteorites, horn, bone, leather, hide, coral, cartilage, semi-transparent minerals, semi-transparent or tinted glasses, ceramics or wood.

18. A timepiece comprising a display assembly according to claim 1.

19. A display assembly comprising:

a display module including a light source to display at least one piece of information; and a dial module to show the display information only when the display is activated, wherein the dial module includes a dial made of a translucent or semi-transparent material underneath which is disposed a semi-reflective element to reflect part of light and to transmit another proportion of light while reducing deflection of light rays by diffusion, the display module being disposed underneath the semi-reflective element, and the semi-reflective element includes a dielectric mirror in a form of a film.

20. A display assembly comprising:

a display module including a light source to display at least one piece of information; and a dial module to show the display information only when the display is activated, wherein the dial module includes a dial made of a translucent or semi-transparent material underneath which is disposed a semi-reflective element to reflect part of light and to transmit another proportion of light while reducing deflection of light rays by diffusion, the display module being disposed underneath the semi-reflective element, and the semi-reflective element includes a dielectric mirror made directly on the dial, with a film being bonded thereon to stiffen the dial.

* * * * *